US005139219A

United States Patent [19]

Navarro

[11] Patent Number: 5,139,219

[45] Date of Patent: Aug. 18, 1992

[54] BAG HOLDER

[76] Inventor: Pablo Navarro, 105 Alder Avenue, Altamonte Springs, Fla. 32714

[21] Appl. No.: 677,293

[22] Filed: Mar. 29, 1991

[51] Int. Cl.[5] ..... A63B 55/04

[52] U.S. Cl. ..... 248/97; 248/99; 248/156

[58] Field of Search ..... 248/95, 97, 99, 100, 248/101, 156, 146; 141/314, 391; 220/404

[56] References Cited

U.S. PATENT DOCUMENTS

| | | | |
|---|---|---|---|
| 808,355 | 12/1905 | Ellison | 248/97 |
| 868,269 | 10/1907 | Hulbert | 248/100 |
| 895,759 | 8/1908 | Hulbert | 248/100 |
| 3,532,314 | 10/1970 | Vosbikian | 248/99 X |
| 4,312,489 | 1/1982 | Paetzold | 248/97 |
| 4,832,304 | 5/1989 | Morgulis | 248/156 X |
| 4,940,201 | 7/1990 | Kurth | 248/101 |

FOREIGN PATENT DOCUMENTS

| | | | |
|---|---|---|---|
| 0163167 | 6/1955 | Australia | 248/97 |
| 2214890 | 9/1989 | United Kingdom | 248/95 |

*Primary Examiner*—Ramon O. Ramirez
*Attorney, Agent, or Firm*—Macdonald J. Wiggins

[57] ABSTRACT

The present invention is a bag holder for plastic trash bags for use outdoors, such as lawns, gardens, and the like. A standard is provided with a pointed lower end, and a foot peg for pushing the end of the standard into the ground. An adjustable clamp assembly is disposed on the standard and may be moved along the standard to a desired point and locked. An elongate flat spring strip of metal or plastic having a length greater than the circumferance of the largest trash bag to be used is attached to the clamp assembly. The spring strip is bent into a circle and the opening of the bag is drawn over the spring strip which is released to hold the bag.

9 Claims, 1 Drawing Sheet

BAG HOLDER

BACKGROUND OF THE INVENTION

1. Field of the Invention

The present invention relates to plastic trash bags, and more particularly to a bag holder for use in collecting yard clippings and trash.

2. Description of the Prior Art

The advent of low cost plastic trash bags has made the clean up of yards from grass, clippings, and other debris. However, it is somewhat difficult to fill such bags, due to the lightness and thinness of the plastic. Bag holders are known in the art, but are generally made to fit a single bag size. Thus, there is a need for a simple yard bag holder that will accommodate a range of bag sizes.

SUMMARY OF THE INVENTION

The present invention is a bag holder for plastic trash bags for use outdoors, such as lawns, gardens, and the like. A standard, formed from pipe or the like, is provided with a pointed lower end, and a foot peg for pushing the end of the standard into the ground. An adjustable clamp assembly is disposed on the standard and may be moved along the standard to a desired point, and locked by means of a thumb screw. An elongate flat spring strip of metal or plastic having a length greater than the circumference of the largest trash bag to be used is attached to the clamp assembly. A peg is provided at one extremity of the strip, and a plurality of holes along the other extremity.

In use, the lower, pointed end of the standard is pushed into the ground with a foot. The foot peg thereafter serves to provide lateral stability of the standard. The clamp assembly is adjusted to a height above the ground level corresponding to at least the length of the trash bag to be used. The trash bag is opened, and the spring strip closed to cause the distal extremities thereof to overlap. The open end of the bag is placed over the closed spring strip which is then released. The elasticity of the spring strip then holds the bag in its open position. The plastic trash bag has sufficient elasticity to permit the peg at one strip end to engage of the holes in the other strip end. As will be recognized, the bag stand of the invention maintains the trash bag open for easy filling. When filled, the spring strip is released, and the bag removed.

It is therefore a principal object of the invention to provide a low cost, easy to use trash bag holder for use in outdoor locations that will hold a trash bag open for filling, and that provides easy release of a filled bag.

It is another object of the invention to provide a trash bag holder that is adjustable to hold various size trash bags.

It is still another object of the invention to provide a trash bag holder that is quickly set up in a yard or the like, and that will be stable during filling.

These and other objects and advantages will become apparent from the following detailed description when read in conjunction with the drawings.

DETAILED DESCRIPTION OF THE PREFERRED EMBODIMENT

Figure 1:
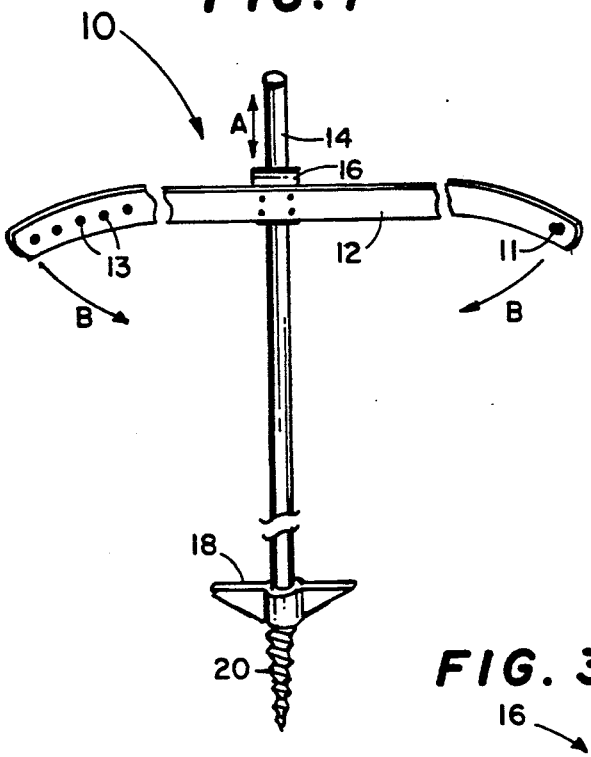
FIG. 1 is a perspective view of the yard trash bag holder of the invention.

Referring to FIG. 1, a bag holder in accordance with the invention is shown in perspective view. A standard 14 is formed of pipe, rod or similar material. A worm-screw type point 20 is attached to the lower end of standard 14, along with a foot peg 18. Movable clamp assembly 16 is attached to standard 14, and includes a thumb screw 17, seen in FIG. 3, that is tightened after adjusting clamp 16 to a desired height in accordance with the length of a bag to be used, as indicated by arrow A.

A spring strip 12, formable into a circular shape, has its midpoint attached to clamp assembly 16 by rivets, or the like. Strip 12 is formed to be bent in essentially a circular shape as indicated by arrows A. A peg 11, extending from the rear surface of strip 12, is attached to one end of strip 12 and mates with holes 13 in the other end of strip 12.

Figure 2:
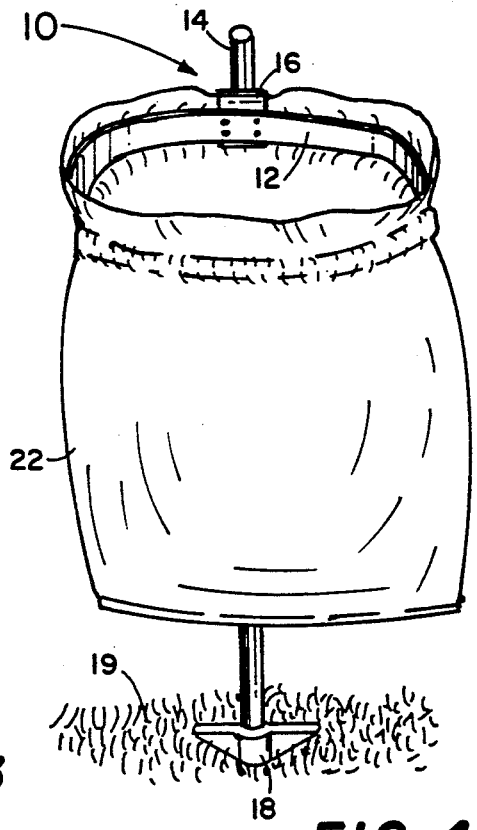
FIG. 2 is a perspective view of the trash bag holder with a trash bag in place thereon.

Turning to FIG. 2, a trash bag 22 is shown installed in the ground 19. Foot peg 18 is pressed firmly into ground 19, and serves to stabilize standard 14. Clamp assembly 16 is shown adjusted to place bag 22 spaced above ground 19, although, in some cases, it may be desirable to have the lower end of bag 22 rest on ground 19. Spring strip 12 has been compressed together to permit bag 22 to have its open end pulled thereover. Spring strip is released after such installation and slightly stretches the upper edge of bag 22. The peg 11 of FIG. 1 is inserted in the appropriate holes 13, thus securely holding bag 22 open.

Figure 3:
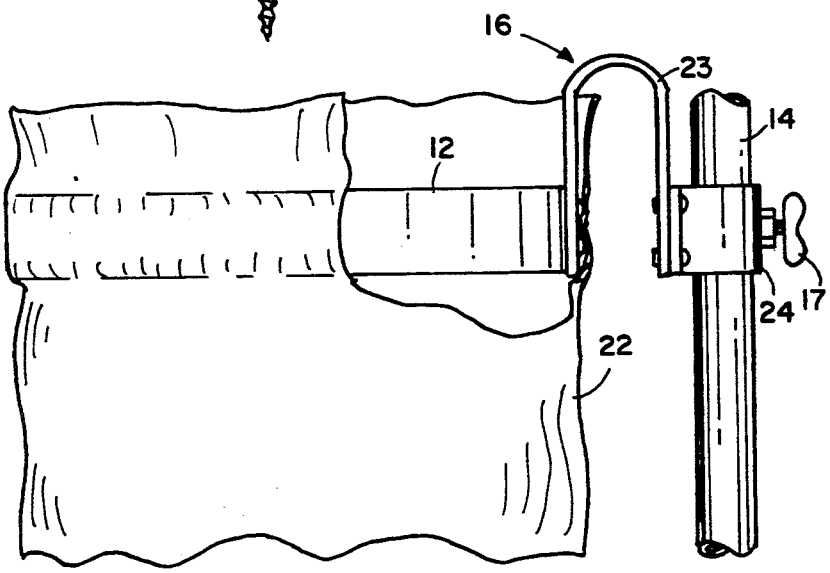
FIG. 3 is a partial side view of the trash bag and holder of FIG. 2, partially cutaway.

In FIG. 3, a partial side view of the installation of FIG. 2 is shown with a part of bag 22 cut away. The construction of clamp assembly 16 is shown having an inverted U-shaped portion with one leg attached to strip 12, and the other leg attached to clamp 24. As will be noted, the rear portion of bag 22 fits in the U-shaped portion.

Standard 14 may be formed from any material or shape that will provide sufficient strength to support the size of bag and type of trash to be handled. However, the preferred construction is steel pipe that provides a strong, relatively low cost material. Spring strip 12 is preferably formed from a stiff, springy plastic. Alternatively, spring steel may be used.

Figure 4:
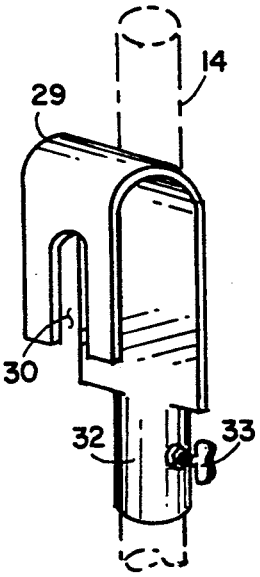
FIG. 4 is a perspective view of a hanger for permitting the trashholder of FIG. 1 to be hung on a door knob.

Referring to FIG. 4, a hanger element 28 is shown that may be used to hang bag holder 10 on a door knob, or similar projection. Thus, bag holder 10 may be used indoors for collecting trash. A sleeve 32 is placed over the upper end of standard 10, shown in phantom view. Hanger element 28 is adjusted to match the height above floor level of the door knob, and locked in place by lock screw 33. A U-shaped member 29, attached to sleeve 32, has a slot 30 in a rear portion thereof for engaging the door knob or other projection.

Although a particular embodiment has been disclosed for exemplary purposes, various changes may be made therein without departing from the spirit and scope of the invention.

I claim:

1. A holder for a trash bag comprising:

a vertically oriented standard;

a clamp member movably attached to said standard; and a spring strip having a central portion and a pair of ends, said central portion attached to said clamp, said strip formable into a generally circular shape;

wherein said spring strip is compressed to permit an open end of a trash bag to be placed thereover, and said spring strip released to cause said open end of said trash bag to be held, said spring strip including means for selectively joining said ends after installation of a trash bag over said spring strip; and said clamp member including thumb screw means for locking said clamp member in a selected position along said standard, and including an inverted U-shaped element having a first leg thereof attached to said clamp member, and a second leg thereof attached to said spring strip.

2. The holder as defined in claim 1 in which said standard includes a pointed lower end.

3. The holder as defined in claim 2 in which said standard includes a foot peg for pushing said lower end into a ground.

4. The holder as defined in claim 2 in which said pointed lower end includes a worm-screw type point.

5. The holder as defined in claim 1 in which said joining means includes a peg attached to one of said ends, and a series of peg-engaging holes along the other of said ends.

6. The holder as defined in claim 1 which further includes a hangar element for engaging said standard, said hangar element adapted to hang said holder from a door knob of a door.

7. A holder for a trash bag, said bag formed of thin sheet plastic comprising:

a vertically oriented standard;

a clamp movably attached to said standard including a clamp member having thumb screw means for locking said clamp in a selected position along said standard, and an inverted U-shaped element having a first leg thereof attached to said clamp member, and a second leg thereof attached to said spring strip;

a strip formed of spring metal having a central portion and a pair of ends, said central portion attached to said clamp;

wherein, during use, distal ends of said spring strip are formed into a generally circular shape to permit an open end of said trash bag to be placed thereover, and released to cause said spring metal strip to stretch said plastic of said open end of said trash bag to thereby hold said trash bag.

8. A holder for a trash bag comprising:

a vertically oriented standard having a pointed lower end for inserting into a ground;

a clamp having a clamp element selectively movably along said standard, and an inverted-U shaped element having a first leg thereof attached to said clamp element;

a spring strip having a central portion thereof attached to a second leg of said inverted-U shaped element, and a pair of ends, said strip formable into a generally circular shape;

wherein said spring strip is compressed to permit an open end of a trash bag to be placed thereover, and released to cause said open end of said trash bag to be held.

9. The holder as defined in claim 8 in which said spring strip includes means for selectively joining said ends after installation of a trash bag over said spring strip, said joining means including a peg attached to one of said ends, and a series of peg-engaging holes along said strip adjacent the other of said ends.

* * * * *